US008671808B2

(12) United States Patent
Huang

(10) Patent No.: US 8,671,808 B2
(45) Date of Patent: Mar. 18, 2014

(54) WRENCH WITH UNIVERSAL DRIVING PART

(76) Inventor: Huei-Feng Huang, Taichung (TW)

( * ) Notice: Subject to any disclaimer, the term of this patent is extended or adjusted under 35 U.S.C. 154(b) by 286 days.

(21) Appl. No.: 13/282,490

(22) Filed: Oct. 27, 2011

(65) Prior Publication Data

US 2013/0104703 A1 May 2, 2013

(51) Int. Cl.
*B25B 23/16* (2006.01)
*B25B 13/46* (2006.01)

(52) U.S. Cl.
USPC ..... 81/177.75; 81/60

(58) Field of Classification Search
USPC ..... 81/177.75, 60, 177.85, 124.7
See application file for complete search history.

(56) References Cited

U.S. PATENT DOCUMENTS

| | | | | |
|---|---|---|---|---|
| 5,630,342 | A * | 5/1997 | Owoc | 81/177.75 |
| 6,971,286 | B2 * | 12/2005 | Hu | 81/63.2 |
| 7,278,342 | B1 * | 10/2007 | Chang | 81/177.75 |
| 7,472,629 | B2 * | 1/2009 | Davidson | 81/60 |
| 7,966,915 | B2 * | 6/2011 | Chen | 81/177.75 |
| 8,176,817 | B2 * | 5/2012 | Liu | 81/177.75 |

* cited by examiner

*Primary Examiner* — Hadi Shakeri

(57) ABSTRACT

A wrench includes a body having a driving head which has a ratchet mechanism having a rotatable ratchet gear. An engaging hole is defined in one side of the ratchet gear and a groove is defined in the inner periphery of the engaging hole. A stop portion extends from the other side of the ratchet gear. A universal connector has a driving part extending from the first end thereof and a head is located on the second end of the universal connector. The head is located within the engaging hole and swingable relative to the axis of the head and non-rotatable relative to the axis of the head. A resilient member is located in the engaging hole and located between the stop portion and the head. A clip is engaged with the groove so as to restrict the universal connector from dropping out from the engaging hole.

5 Claims, 10 Drawing Sheets

WRENCH WITH UNIVERSAL DRIVING PART

FIELD OF THE INVENTION

The present invention relates to a wrench, and more particularly, to a ratchet wrench with a universal driving part so as to be operated in different directions.

BACKGROUND OF THE INVENTION

A conventional universal wrench is disclosed in U.S. Pat. No. 3,897,703 and includes a first connector and a second connector, wherein the first end of the first connector has a rectangular hole so as to be connected with the driving part of the socket wrench, and the second end of the first connector has a hexagonal hole. The first end of the second connector has a head with a hexagonal and curved outer surface. The head is accommodated in the hexagonal hole. The second end of the second connector has a hexagonal recess so as to be mounted to a bolt. The most universal wrench has rectangular driving part to be connected with a socket like the wrench disclosed in U.S. Pat. No. 4,188,801.

The connection between the first and second connectors in U.S. Pat. No. 3,897,703 uses the hexagonal recess accommodating the head so that the head can be pivoted. However, when the rectangular hole of the first connector is connected with a socket wrench, the rectangular driving part of the second is then connected with a socket, the socket wrench, the universal connector and the socket is located on a straight line which extends for a significant distance and is not convenient for operation in a limited space such as in an engine room. If the hexagonal recess of the second connector is directly mounted to a bolt, although the total length is shortened, only one fixed sized bolt can be operated and this cannot meet the requirements of the users.

The present invention intends to provide a wrench with is easily operated and improves the shortcomings of the conventional universal wrenches.

SUMMARY OF THE INVENTION

The present invention relates to a wrench includes a body, a universal connector, a resilient member and a clip. The body has a driving head which has a ratchet mechanism having a rotatable ratchet gear. An engaging hole is defined in one side of the ratchet gear and a groove is defined in the inner periphery of the engaging hole. The stop portion extends from the other side of the ratchet gear. The universal connector has a driving part extending from the first end thereof and a head is located on the second end of the universal connector. The head is located within the engaging hole and swingable relative to the axis of the head and non-rotatable relative to the axis of the head. The resilient member is located in the engaging hole and located between the stop portion and the head. The clip is engaged with the groove so as to restrict the universal connector from dropping out from the engaging hole.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
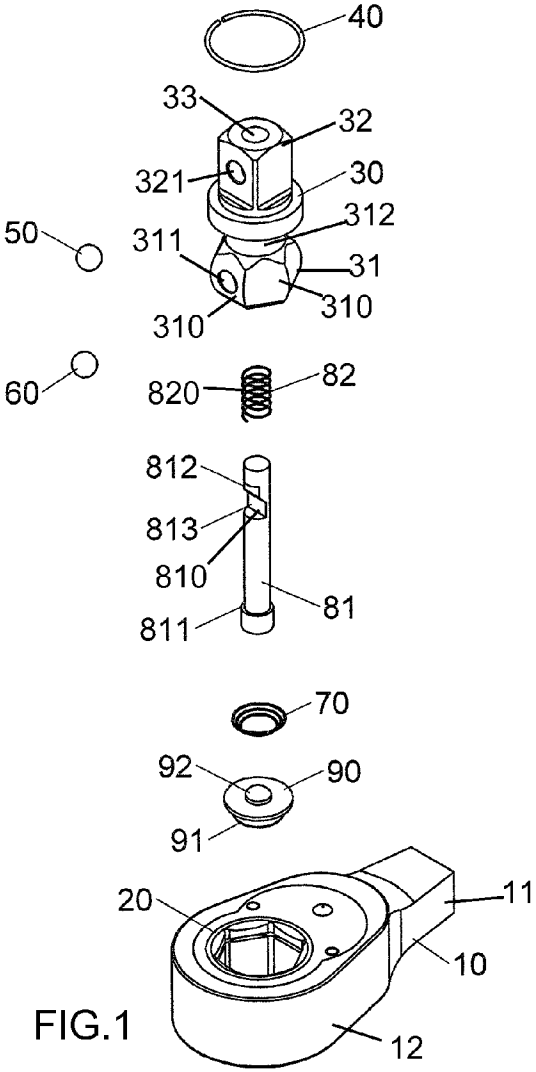
FIG. 1 is an exploded view to show the wrench of the present invention.
Figure 2:
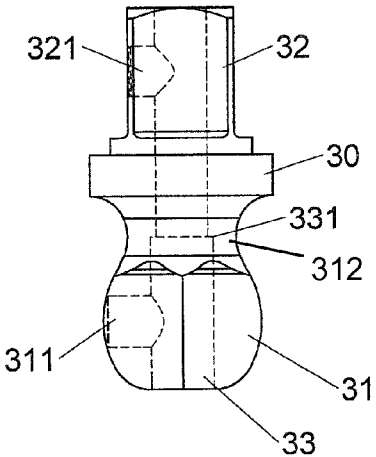
FIG. 2 is a side view of the universal connector of the wrench of the present invention.
Figure 3:
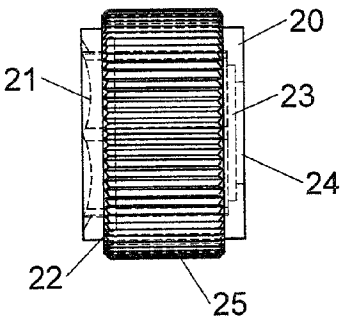
FIG. 3 is a side view of the ratchet gear of the wrench of the present invention.
Figure 4:
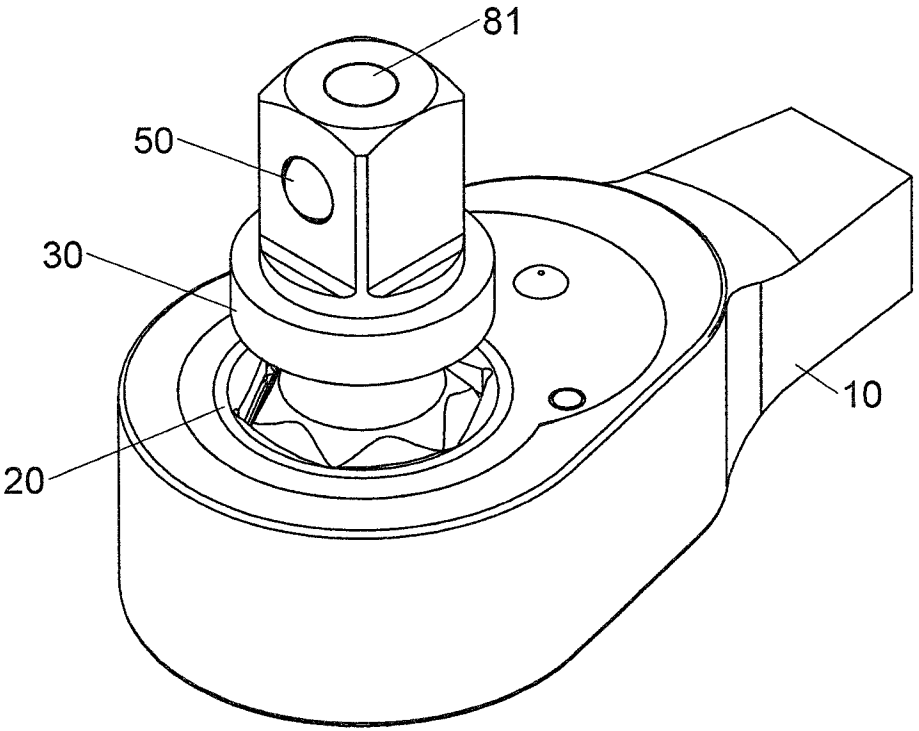
FIG. 4 is a perspective view to show the wrench of the present invention.
Figure 5:
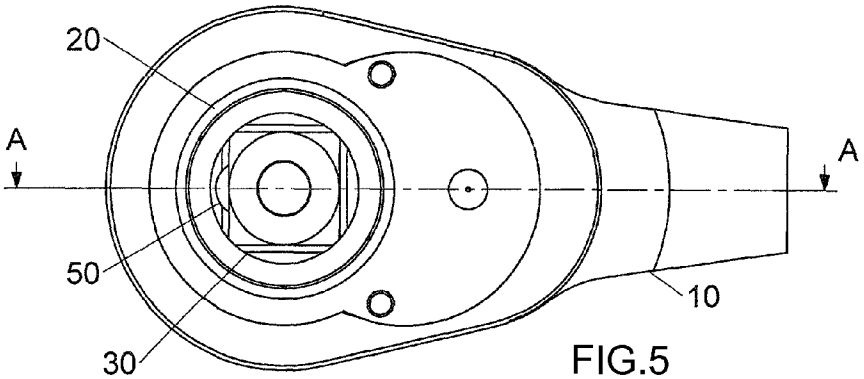
FIG. 5 is a top view of the wrench of the present invention.
Figure 6:
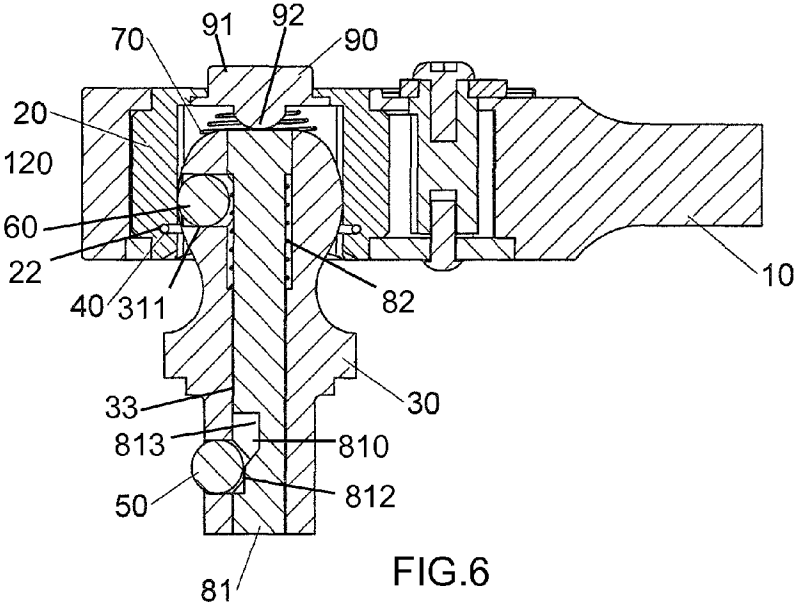
FIG. 6 is a cross sectional view, taken along line A-A of FIG. 5.
Figure 7:
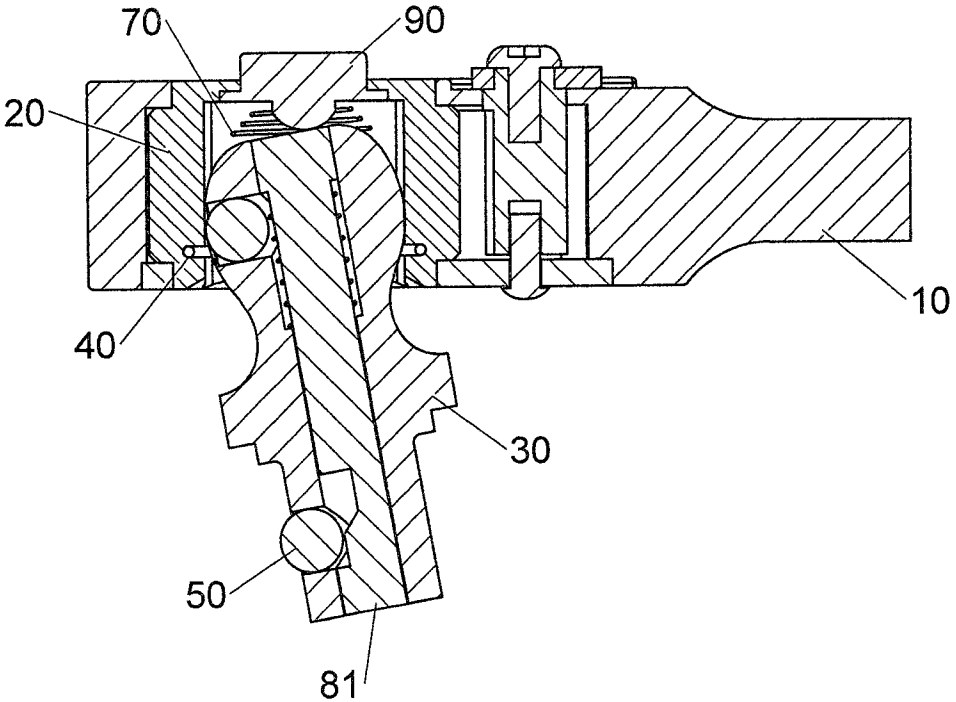
FIG. 7 is a cross sectional view showing that the universal connector swings.

Referring to FIGS. 1 to 7, the wrench of the present invention comprises a body 10, a universal connector 30, a first resilient member 70, and a clip 40. The body 10 has a handle 11 and a driving head 12 is connected to an end of the handle 11. The driving head 12 has a ratchet mechanism received therein which has a rotatable ratchet gear 20 with multiple ratchet teeth 25 formed on the outer periphery of the ratchet gear 20. An engaging hole 21 is defined in one side of the ratchet gear 20 and a groove 22 is defined in the inner periphery of the engaging hole 21. A stop portion 23 extends from the other side of the ratchet gear 20. In this embodiment, the engaging hole 21 is a hexagonal hole. The universal connector 30 has a first end with a driving part 32 and a head 31 is located on the second end of the universal connector 30. The driving part 32 is a rectangular part so as to be connected with an object. The head 31 is located within the engaging hole 21 and swingable relative to the axis of the head 31 and non-rotatable relative to the axis of the head 31. The head 31 has six sides 310 which are matched with the hexagonal engaging hole 21. Each side 310 is a curved side which extends along the axis direction of the head 31. The first resilient member 70 is located in the engaging hole 21 and located between the stop portion 23 and the head 31. The clip 40 is engaged with the groove 22 and protrudes out from the groove 22 so as to contact the head 31 to restrict the universal connector 30 from dropping out from the engaging hole 21.

The stop portion 23 has a mounting hole 24 defined centrally therethrough and a cover 90 is mounted to cover the through mounting hole 24. The cover 90 has a protrusion 92 on one side and a pressing portion 91 the other side. The cover 90 is biased by the first resilient member 70 to contact the stop portion 23 so as to prevent the cover 90 from disengaging from the engaging hole 21. The universal connector 30 has a through hole 33 defined axially therethrough and a pin 81 is movably located in the through hole 33. A second resilient member 82 is located between the pin 81 and the universal connector 30, the second resilient member 82 biases the pin 81 toward the head 31. The pin 81 has a first end and a second which is located opposite to the first end. The first end extends out from the through hole 33 of the head 31 and the protrusion 92 of the cover 90 is located corresponding to the first end of the pin 81. A first bead hole 321 is defined through the driving part 32 and communicates with the through hole 33. A first bead 50 is located in the first bead hole 321. The pin 81 has a recess 810 which includes a first portion 812 and a second portion 813 which is deeper than the first portion 812. The first portion 812 is located corresponding to the first bead hole 321. The first bead 50 partially protrudes from the driving part 32 so that the protrusion 92 is engaged with a recessed area of the object connected with the driving part 32. The protrusion 92 pushes the pin 81 within the through hole 33 when the cover 90 is applied by a force. When the second portion 813 is located corresponding to the first bead hole 321, the first bead 50 is completely merged into the first bead hole 321. Therefore, the object can be removed from the driving part 32.

The pin 81 has an enlarged first flange 811 located close to the first end of the pin 81 and a second flange 331 is located in the through hole 33, the second flange 331 is located corresponding to the first flange 811. The second resilient member 82 is a spring 820 whose inner diameter larger than the outer diameter of the pin 81. The spring 820 is mounted to the pin 81 and biased between the first and second flanges 811, 331. A second bead hole 311 is defined through the head 31 and communicates with the through hole 33. A second bead 60 is located in the second bead hole 311 and biased by the spring 820 to partially protrude out from the head 31.

Figure 8:
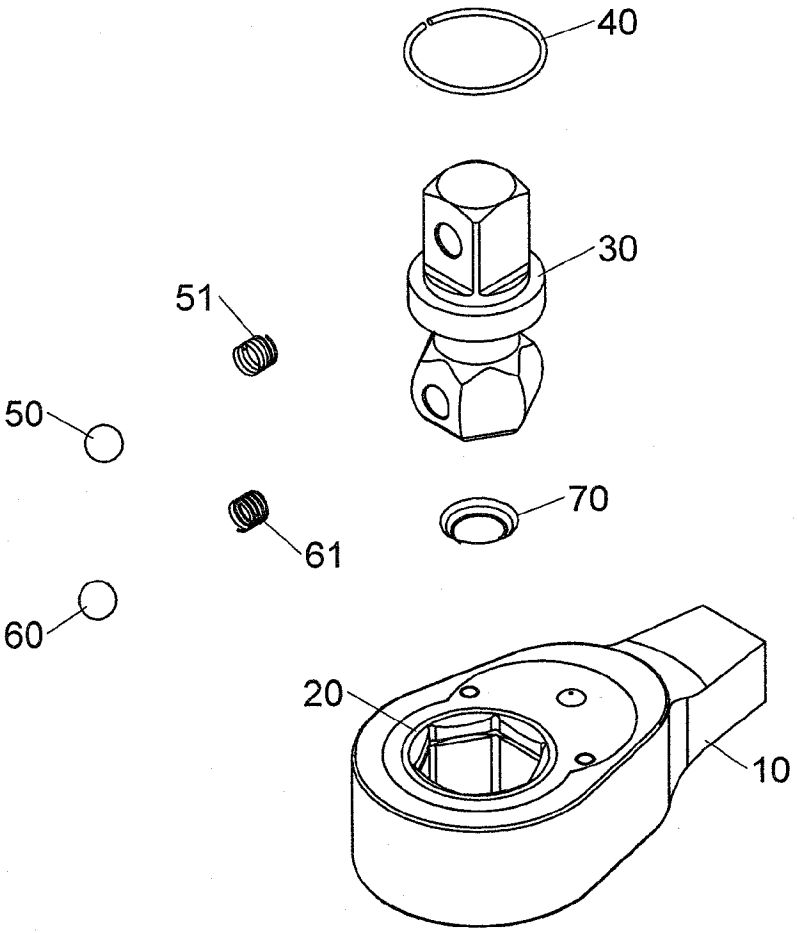
FIG. 8 is an exploded view to show the second embodiment of the wrench of the present invention.
Figure 9:
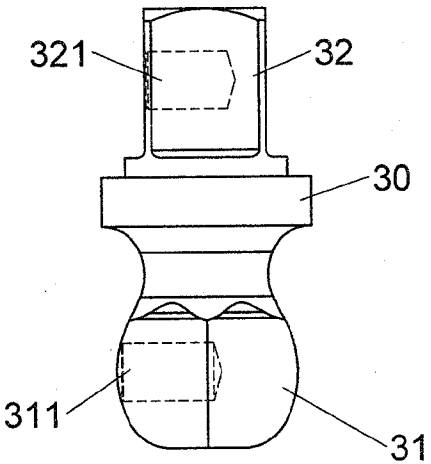
FIG. 9 is a side view of the universal connector of the second embodiment of the wrench of the present invention.
Figure 10:
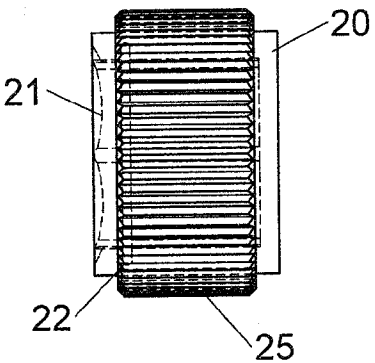
FIG. 10 is a side view of the ratchet gear of the second embodiment of the wrench of the present invention.
Figure 11:
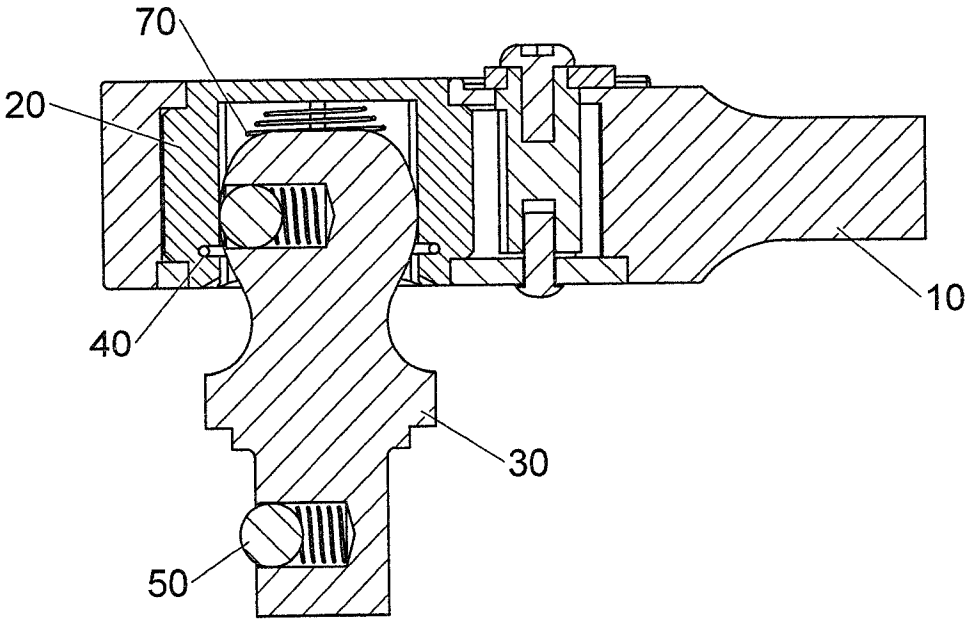
FIG. 11 is a cross sectional view of the second embodiment of the wrench of the present invention.

As shown in FIGS. 8 to 10, one end of the engaging hole 21 is sealed by the driving part 32. The first bead hole 321 and the second bead hole 311 are respectively located in the driving part 32 and the head 31. A spring 51 and a first bead 50 are located in the first bead hole 321, and a spring 61 and a second bead 60 are located in the second bead hole 311. The first bead 50 and the second bead 60 are respectively biased by the springs 51, 61 and respectively partially protrude out from the driving part 32 and the head 31. The first bead 50 is engaged with the recessed area of the object connected to the driving part 32 and the second bead 60 contacts the inside of the engaging hole 21 to increase the friction.

Figure 12:
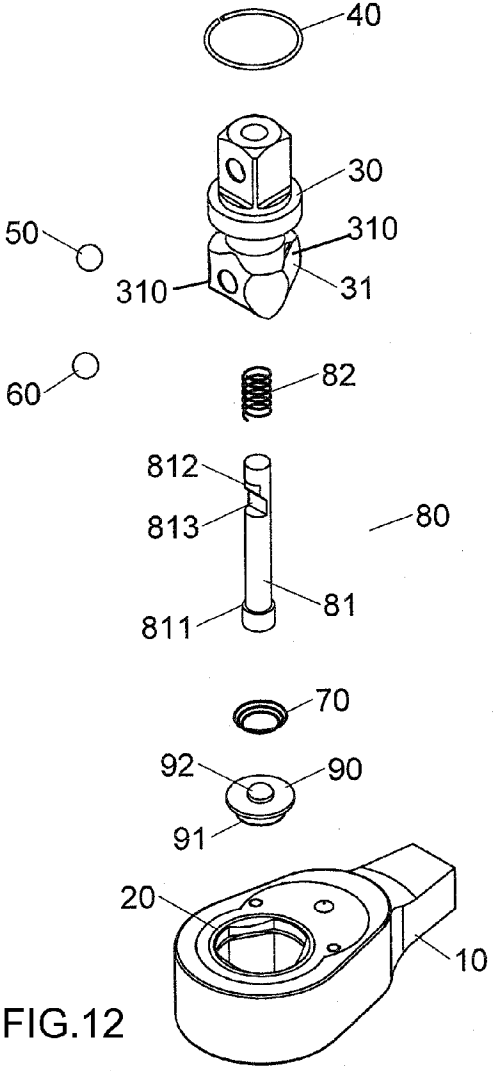
FIG. 12 is an exploded view to show the third embodiment of the wrench of the present invention.

As shown in FIG. 12, the engaging hole 21 is a hexagonal hole and the head 31 has three sides which are matched with the hexagonal engaging hole 21. Each side is a curved side which extends along the axis direction of the head 31.

Figure 13:
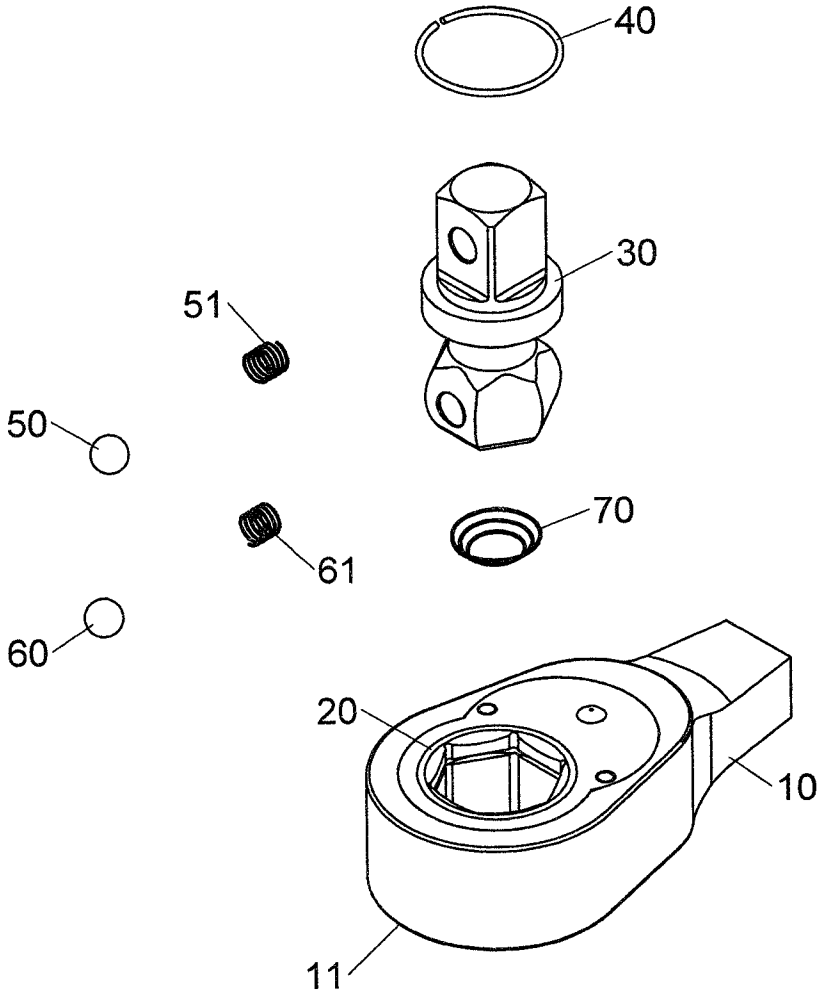
FIG. 13 is an exploded view to show the fourth embodiment of the wrench of the present invention.
Figure 14:
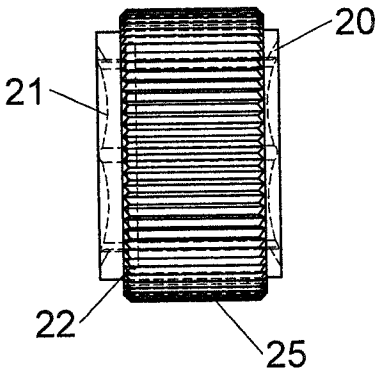
FIG. 14 is a side view of the ratchet gear of the fourth embodiment of the wrench of the present invention.
Figure 15:
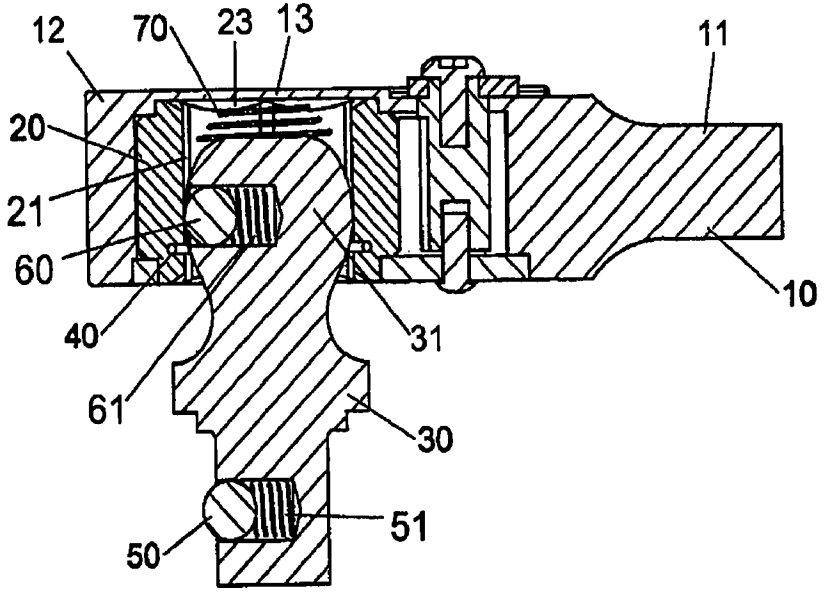
FIG. 15 is a cross sectional view of the fourth embodiment of the wrench of the present invention.

As shown in FIGS. 13 to 15, the engaging hole 21 has an end with the stop portion 23 is closed by the closed portion 13 of the driving head 12. The first resilient member 70 is biased between the closed portion 13 and the head 31.

Figure 16:
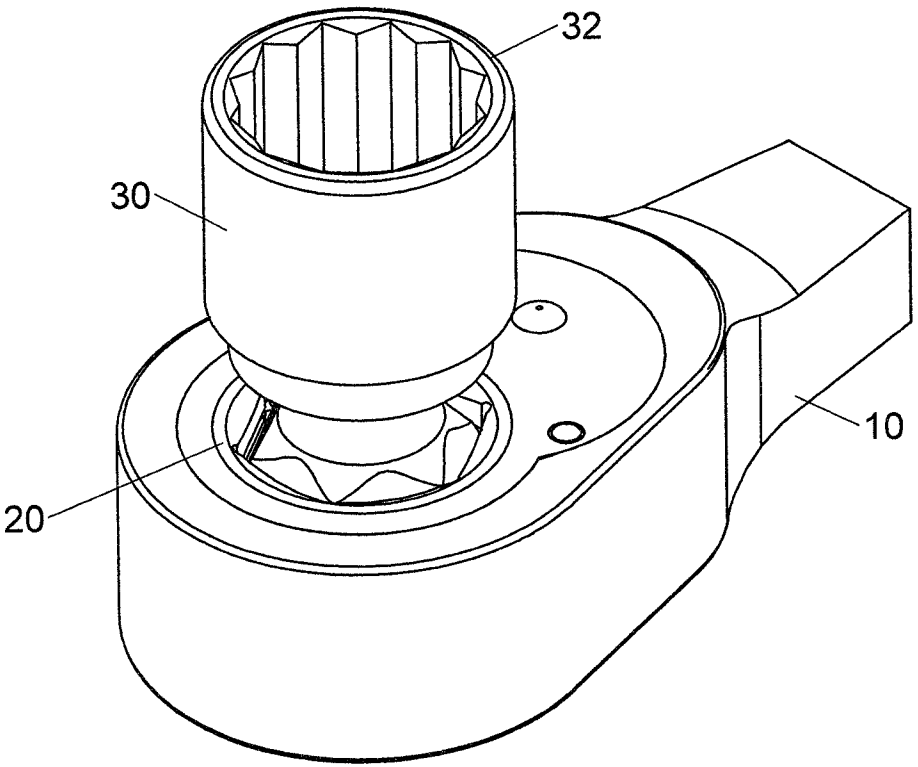
FIG. 16 is a perspective view to show the fifth embodiment of the wrench of the present invention.

FIG. 16 shows that the driving part 32 is a socket so as to mount to a bolt or nut.

While we have shown and described the embodiment in accordance with the present invention, it should be clear to those skilled in the art that further embodiments may be made without departing from the scope of the present invention.

What is claimed is:

1. A wrench comprising:

a body having a handle and a driving head connected to an end of the handle, the driving head having a ratchet mechanism which has a rotatable ratchet gear with multiple ratchet teeth formed on an outer periphery of the ratchet gear, an engaging hole defined in one side of the ratchet gear and a groove defined in an inner periphery of the engaging hole, a stop portion extending from the other side of the ratchet gear; the stop portion having a mounting hole defined centrally therethrough and a cover being mounted to cover the through hole, the cover being biased by the first resilient member to contact the stop portion, the universal connector having a through hole defined axially therethrough, a pin being movably located in the through hole and a second resilient member being located between the pin and the universal connector, the second resilient member biasing the pin toward the head, the pin having a first end and a second which is located opposite to the first end, the first end extending out from the through hole of the head, the cover having a protrusion which is located corresponding to the first end of the pin, a first bead hole being defined through the driving part and communicating with the through hole, a first bead being located in the first bead hole, the pin having a recess which includes a first portion and a second portion which is deeper than the first portion, the first portion being located corresponding to the first bead hole, the first bead partially protruding from the driving part, the protrusion pushing the pin within the through hole when the cover being applied by a force, the second portion being located corresponding to the first bead hole and the first bead being completely merged into the first bead hole;

a universal connector having a first end with a driving part and a head located on a second end of the universal connector, the head located within the engaging hole and swingable relative to an axis of the head and non-rotatable relative to the axis of the head;

a first resilient member located in the engaging hole and located between the stop portion and the head, and a clip engaged with the groove and protruding out from the groove so as to contact the head to restrict the universal connector from dropping out from the engaging hole.

2. The wrench as claimed in claim 1, wherein the pin has an enlarged first flange located close to the first end of the pin and a second flange located in the through hole, the second flange is located corresponding to the first flange, the second resilient member is a spring which has an inner diameter larger than an outer diameter of the pin, the spring is mounted to the pin and biased between the first and second flanges, a second bead hole is defined through the head and communicates with the through hole, a second bead is located in the second bead hole and biased by the spring to partially protrude out from the head.

3. The wrench as claimed in claim 1, the driving part is a rectangular part.

4. The wrench as claimed in claim 1, wherein the engaging hole is a hexagonal hole and the head has six sides which are matched with the hexagonal engaging hole, each side is a curved side which extends along the axis direction of the head.

5. The wrench as claimed in claim 1, wherein the head has three sides which are matched with the hexagonal engaging hole, each side is a curved side which extends along the axis direction of the head.

* * * * *